US006568042B2

(12) United States Patent
Camozzi

(10) Patent No.: US 6,568,042 B2
(45) **Date of Patent: *May 27, 2003**

(54) UNIT FOR CONDENSING A BUNDLE OF TEXTILE FIBRES DRAFTED IN A SPINNING MACHINE

(75) Inventor: Attilio Camozzi, Brescia (IT)

(73) Assignee: Marzoli S.p.A., Brescia (IT)

( * ) Notice: Subject to any disclaimer, the term of this patent is extended or adjusted under 35 U.S.C. 154(b) by 0 days.

This patent is subject to a terminal disclaimer.

(21) Appl. No.: 10/134,496

(22) Filed: Apr. 30, 2002

(65) Prior Publication Data

US 2002/0157219 A1 Oct. 31, 2002

(30) Foreign Application Priority Data

Apr. 30, 2001 (IT) ..... TO2001A0407

(51) Int. Cl.[7] ..... D01H 5/00
(52) U.S. Cl. ..... 19/246; 19/236; 19/150
(58) Field of Search ..... 19/150, 236–250, 19/252, 263, 286, 287, 288, 304–308; 57/264, 304, 315, 328, 333; 15/256.51, 256.52, 256.53, 301, 312.1, 314

(56) References Cited

U.S. PATENT DOCUMENTS

| | | | | | |
|---|---|---|---|---|---|
| 4,953,349 | A | * | 9/1990 | Fehrer | 57/315 |
| 5,600,872 | A | * | 2/1997 | Artzt et al. | 19/244 |
| 6,161,258 | A | * | 12/2000 | Stahlecker | 19/150 |
| 6,170,126 | B1 | * | 1/2001 | Stahlecker | 19/150 |
| 6,332,244 | B1 | | 12/2001 | Camozzi | |

FOREIGN PATENT DOCUMENTS

| | | | | |
|---|---|---|---|---|
| IT | 0 106 719 A | * | 6/2001 | D01H/5/72 |

* cited by examiner

*Primary Examiner*—Gary L Welch
(74) *Attorney, Agent, or Firm*—Sughrue Mion, PLLC

(57) ABSTRACT

A fixed tube of circular cross-section, which is common to several spinning stations located side by side, is connected to a suction source and has, in each station, a suction slot which is located on the path of the bundle of fibers to be condensed and is elongate along the direction of movement thereof. In each spinning station, the tube has a second suction opening located proximate to each suction slot.

7 Claims, 2 Drawing Sheets

UNIT FOR CONDENSING A BUNDLE OF TEXTILE FIBRES DRAFTED IN A SPINNING MACHINE

BACKGROUND OF THE INVENTION

The present invention relates to a condensing unit for condensing a bundle of textile fibres drafted in a spinning machine.

The field of application of the present invention is that of spinning machines having a plurality of adjacent spinning stations in each of which there is a drafting unit associated with a condensing unit for transforming a bundle of textile fibres, or roving, into a twisted yarn.

For a better understanding of the prior art and of the problems inherent therein, a conventional condensing unit will be described first of all with reference to FIGS. 1 and 2 of the appended drawings.

In FIG. 1, a bundle of textile fibres or roving 1 is supplied to a drafting unit, generally indicated 2, comprising three pairs of rollers 3 and 4, 5 and 6, 7 and 8, which pull the roving along at increasing linear velocities in order to thin it gradually. The roving output from the drafting unit 2 then goes to a condensing unit 10 located downstream of the drafting unit, before being sent for twisting.

The condensing unit 10 comprises a lower fixed tube 11 of circular cross-section, connected to a suction source (not shown), by means of a manifold 12. As shown in FIG. 2, the tube 11, which is common to several spinning stations located side by side, has, in each station, a narrow suction slot 15 arranged on the path of and in the direction of movement of the roving.

A plurality of freely rotatable cylindrical sleeves 16 are mounted along the tube 11, there being one sleeve in the region of each spinning station and each sleeve having a central perforated portion 17 which extends around the entire circumference of the sleeve and covers the corresponding slot 15 with a large margin. Each sleeve 16 is driven so as to move around the tube 11 by a pressure roller 18 of elastomeric material which presses the roving against the perforated portion 17 of the filtering sleeve 16. The inside diameter of the sleeves 16 is of a size such that the sleeves can be mounted on the tube with a minimal clearance which does not hinder their rotation. The pressure roller 18 is rotated by the last pressure roller 7 of the drafting unit 2, by means of a belt transmission 19.

An example of this prior art is described in EP-1106719-A, which is incorporated herein by reference.

SUMMARY OF THE INVENTION

The object of the present invention is to provide a condensing unit of the type discussed above, addressing principally the problem of preventing the formation of accumulations of microfibres and dirt which tend to be deposited both in the interface region between the sleeve and the tube and on the perforated portion of the filtering sleeve, adversely affecting the condensing operation.

This and other objects and advantages which will be understood further from the following description.

BRIEF DESCRIPTION OF THE DRAWINGS

The characteristics and the advantages of the invention will become clear from the detailed description of some embodiments thereof, which is given with reference to the appended drawings provided by way of non-limiting example, in which.

DETAILED DESCRIPTION OF THE INVENTION

Figure 1:
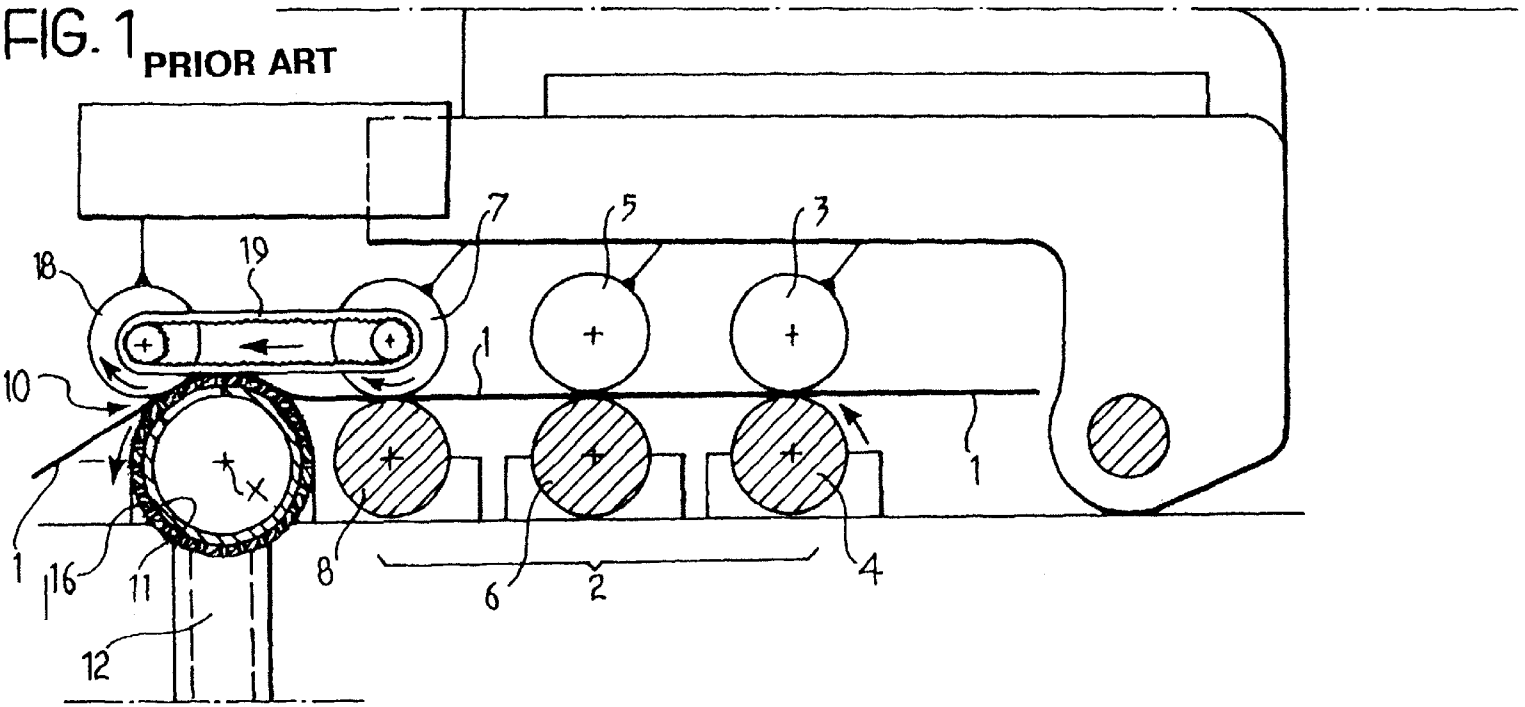
FIG. 1 PRIOR ART
FIG. 1 is a partially-sectioned, side elevational view of a drafting unit and of a condensing unit according to the invention.
Figure 2:
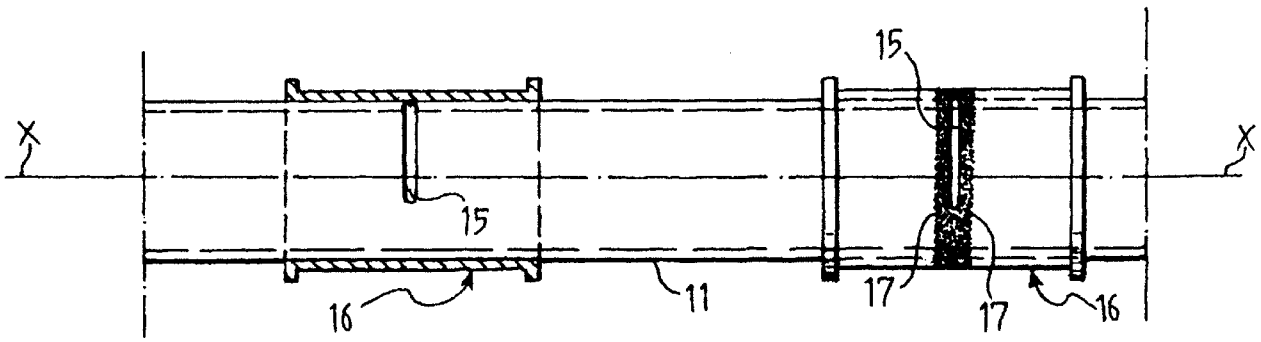
FIG. 2 (PRIOR ART)
FIG. 2 is a plan view showing, on an enlarged scale and partially in section, some portions of a conventional condensing unit in two adjacent spinning stations.

The general configuration of the condensing unit shown in FIG. 1 can be considered generally known. Only the elements which are of specific importance and interest for the purposes of the implementation of the present invention will therefore be described in detail in the following portion of the present description. For the construction of the parts and of the elements which are not described in detail, reference may therefore be made to any condensing unit of known type.

Figure 3:
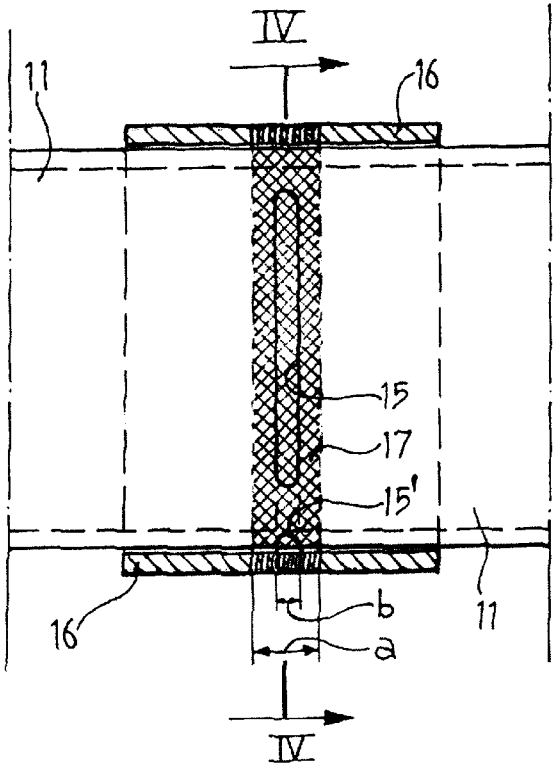
FIG. 3 is a plan view showing, on an enlarged scale and partially in section, some portions of a condensing unit according to a first embodiment of the invention.

In FIG. 3, according to the present invention, downstream of each suction slot 15, the tube 11 has a further suction opening 15' the radial axis of which is preferably inclined at an angle $\alpha$ of between approximately 5° and 50° relative to the angular position of the downstream end portion of the slot 15. The opening 15' is preferably located in the same radial plane as the respective slot 15.

Whilst not wishing to be bound to any specific theory in this connection, the Applicant has carried out tests which show that, by virtue of the opening 15', a circulation of air is created such that the microfibres which are present in the area surrounding the condensing unit no longer tend to be deposited on the slot itself, in the region of the cylindrical surfaces at the interface between the tube 11 and each sleeve 16, or on the perforated portions of the sleeves, which thus remain clean.

The selection of the dimensions of the slots 15 is influenced, in general, by the drafting and condensing operations, by the type of roving to be processed, and by the suction capacities and pressures available.

Even better results are achieved if, as shown in FIG. 3 (not to scale), the central perforated portion 17 in each sleeve preferably has an axial width "a" which is approximately 1÷3% larger than the maximum axial width "b" of the corresponding slot 15, in order to be able to cover the slot.

Figure 5:
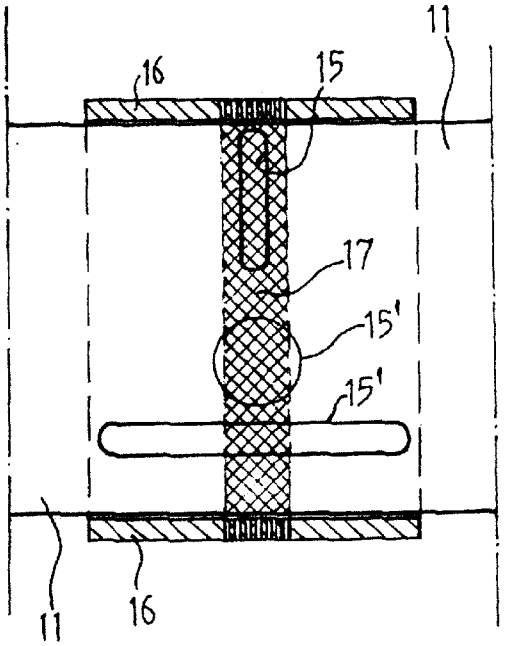
FIG. 5 is a view similar to FIG. 3, showing schematically two alternative embodiments of the suction openings which can be produced in a tube of a condensing unit according to the invention.
Figure 4:
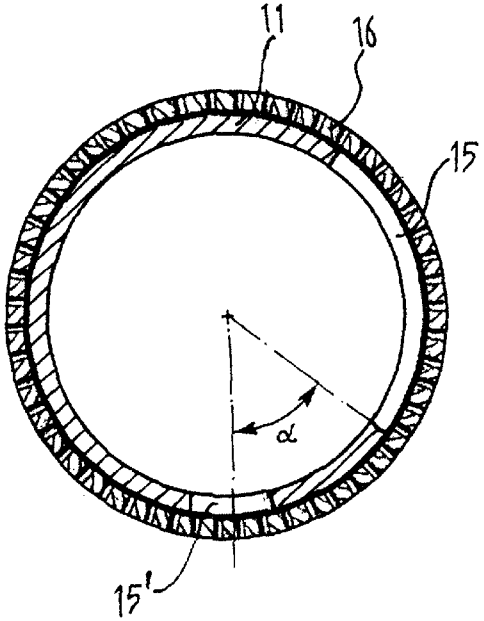
FIG. 4 is a cross-section taken on the line IV—IV of FIG. 3.

The dimensions of the suction opening 15' may vary in dependence on the width of the sleeve 16 or of the perforated region 17. For example, as shown in FIG. 5, the suction opening 15' may be of a substantially circular shape with a diameter comparable to or slightly greater than the axial width of the perforated region 17 of the sleeve 16 or, alternatively, may have a shape which is elongate in the axial direction, with an axial dimension comparable to that of the corresponding sleeve.

The rotary sleeves 16 may be made of plastics, metal or sintered material and are preferably made of synthetic polymer materials having good mechanical and self-lubricating properties, for example, plastics materials based on polyamides, polyaldehydes and the like, which reduce the sliding friction that develops during the rotary movement about the tube 11. Alternatively, the sleeves 16 may be replaced by equivalent filtering elements in the form of endless belts, as are known, for example, from EP-1106719-A.

What is claimed is:

1. A condensing unit for condensing a bundle of textile fibers coming from a drafting unit in a spinning station of a spinning machine, the condensing unit comprising a fixed tube of circular cross-section, which is common to several spinning stations located side by side, the tube being connected to a suction source and having at each station a suction slot which is located on the path of the bundle of fibers and is elongate along the direction of movement thereof, a filtering element mounted so as to be freely rotatable on the fixed tube at each spinning station, the filtering element having at least one perforated portion located in the region of at least one corresponding slot, said filtering element being caused to circulate around the fixed tube, coherently with the bundle of fibres, for transporting the bundle of fibres, wherein the tube has, at each spinning station, a second suction opening located proximate to each suction slot.

2. The condensing unit of claim 1, the second suction openings are located downstream of the respective suction slots, with reference to the direction of movement of the bundle of fibres.

3. The condensing unit of claim 1, wherein the second suction openings are aligned with the respective suction slots in substantially radial planes.

4. The condensing unit of claim 1, Wherein the second suction openings are arranged in a manner such that the radial axis of each suction opening is inclined at an angle of between approximately 5° and 50° relative to the angular position of the downstream end portion of the respective slot.

5. The condensing unit of claim 1, wherein the perforated portion of the filtering element has an axial width which is approximately 1–3% greater than the maximum axial width of the slot.

6. The condensing unit of claim 1, wherein the second suction opening has a substantially circular shape with a diameter comparable to or slightly greater than the axial width of the perforated portion of the filtering element.

7. The condensing unit of claim 1, wherein the second suction opening has a shape which is substantially elongate in the axial direction, with an axial dimension comparable to that of the corresponding filtering element.

* * * * *